US009333523B2

(12) United States Patent
Lowy

(10) Patent No.: US 9,333,523 B2
(45) Date of Patent: May 10, 2016

(54) ATOMIZING SPRAY APPARATUS

(71) Applicant: OMNIMIST, LTD., Pukekohe (NZ)

(72) Inventor: Jonathan David Lowy, Auckland (NZ)

(73) Assignee: OMNIMIST, LTD., Pukekohe (NZ)

( * ) Notice: Subject to any disclaimer, the term of this patent is extended or adjusted under 35 U.S.C. 154(b) by 0 days.

(21) Appl. No.: 14/481,261

(22) Filed: Sep. 9, 2014

(65) Prior Publication Data

US 2015/0069146 A1 Mar. 12, 2015

Related U.S. Application Data

(60) Provisional application No. 61/875,257, filed on Sep. 9, 2013.

(51) Int. Cl.
*B05B 17/06* (2006.01)
*B05B 17/00* (2006.01)

(52) U.S. Cl.
CPC ..... *B05B 17/0646* (2013.01)

(58) Field of Classification Search
CPC B05B 17/06; B05B 17/0607; B05B 17/0623; B05B 17/063; B05B 17/0638; B05B 17/0646; B05B 17/0669; A61M 11/005; A61M 15/0085
See application file for complete search history.

(56) References Cited

U.S. PATENT DOCUMENTS

| | | | | |
|---|---|---|---|---|
| 3,392,916 | A | 7/1968 | Herzog | |
| 3,970,250 | A | 7/1976 | Drews | |
| 4,357,553 | A | 11/1982 | Minagawa | |
| 4,410,139 | A | 10/1983 | Nishikawa | |
| 4,605,167 | A | 8/1986 | Maehara | |
| 4,632,311 | A | 12/1986 | Maehara | |
| 5,011,632 | A | 4/1991 | Hashimoto | |
| 5,518,179 | A * | 5/1996 | Humberstone | ..... B05B 17/0646 239/102.2 |
| 5,588,592 | A | 12/1996 | Wilson | |
| 5,836,515 | A | 11/1998 | Ching | |
| 6,039,212 | A | 3/2000 | Singh | |
| 6,296,196 | B1 | 10/2001 | Headings | |
| 6,339,897 | B1 | 1/2002 | Frederickson | |
| 6,357,726 | B1 | 3/2002 | Law | |
| 6,382,522 | B2 | 5/2002 | Tomkins | |
| 6,450,419 | B1 | 9/2002 | Clark | |
| 6,550,472 | B2 | 4/2003 | Behzadian | |

(Continued)

FOREIGN PATENT DOCUMENTS

| | | |
|---|---|---|
| CN | 102009023 A | 4/2011 |
| DE | 2557958 | 6/1977 |

(Continued)

*Primary Examiner* — Darren W Gorman
(74) *Attorney, Agent, or Firm* — Bacon & Thomas, PLLC

(57) ABSTRACT

A spray apparatus includes a pump, a reservoir and an atomizing unit in fluid communication within a fluid circuit. The atomizing unit comprises a housing enclosure defining an enclosed interior space. An aperture is defined a front wall of the housing, and an ultrasonic atomizer is disposed within the interior space proximate to the aperture. A fluid supply port extends into the interior space, arranged to deliver a fluid pumped by the pump to the ultrasonic atomizer. An overflow return port extends from the interior space, and is arranged to return fluid from the interior space to the reservoir. The fluid supply port may be arranged to deliver a fluid into a fluid receiving space such that the atomizer becomes at least partially immersed within a fluid during operation. Alternatively, the fluid supply port may be arranged to direct a stream of fluid against a surface of the atomizer.

13 Claims, 8 Drawing Sheets

(56) References Cited

U.S. PATENT DOCUMENTS

| | | | | |
|---|---|---|---|---|
| 6,651,650 | B1 | 11/2003 | Asai | |
| 6,802,460 | B2 | 10/2004 | Hess | |
| 6,915,962 | B2 | 7/2005 | Power | |
| 6,921,020 | B2 * | 7/2005 | Ivri | A61M 11/005 239/102.2 |
| 7,195,011 | B2 | 3/2007 | Helmlinger | |
| 7,219,848 | B2 | 5/2007 | Sweeton | |
| 7,284,713 | B2 | 10/2007 | Dunne | |
| 7,502,665 | B2 | 3/2009 | Giles | |
| 7,610,118 | B2 | 10/2009 | Helf | |
| 7,621,266 | B2 | 11/2009 | Kladders | |
| 7,682,354 | B2 | 3/2010 | Lubetkin | |
| 7,770,757 | B2 | 8/2010 | Helmlinger | |
| 8,061,629 | B2 | 11/2011 | Richer | |
| 2007/0044792 | A1 | 3/2007 | Ivri | |
| 2007/0089365 | A1 | 4/2007 | Rowe | |
| 2007/0255451 | A1 | 11/2007 | Jones | |
| 2008/0027143 | A1 | 1/2008 | Munagavalasa | |
| 2008/0236577 | A1 | 10/2008 | Clancy | |
| 2008/0315005 | A1 | 12/2008 | Michaels | |
| 2009/0121043 | A1 | 5/2009 | Chen | |
| 2009/0134235 | A1 * | 5/2009 | Ivri | B05B 17/0646 239/4 |
| 2011/0089260 | A1 | 4/2011 | Van Roemburg | |
| 2011/0245984 | A1 | 10/2011 | Beebe | |
| 2012/0046790 | A1 | 2/2012 | Anderson | |
| 2013/0327322 | A1 * | 12/2013 | Bentvelsen | A61M 11/005 128/200.16 |

FOREIGN PATENT DOCUMENTS

| | | | |
|---|---|---|---|
| DE | 4424785 | A1 | 1/1996 |
| DE | 19917093 | A1 | 10/2000 |
| EP | 123277 | | 10/1984 |
| EP | 1762264 | | 9/2005 |
| EP | 2548655 | | 6/2012 |
| FR | 2658738 | | 8/1991 |
| FR | 2658738 | A1 | 8/1991 |
| GB | 1434746 | A | 5/1976 |
| GB | 8616815 | A | 8/1986 |
| GB | 2473855 | | 9/2009 |
| JP | 58055066 | A2 | 4/1983 |
| JP | 8332425 | A2 | 12/1996 |
| WO | WO9938621 | A1 | 8/1999 |
| WO | WO0078367 | A1 | 12/2000 |
| WO | WO2004010762 | A2 | 2/2004 |
| WO | WO2008098597 | A1 | 8/2008 |
| WO | WO2009031891 | A1 | 3/2009 |
| WO | WO2011026968 | A1 | 3/2011 |
| WO | WO2011059494 | A2 | 5/2011 |
| WO | WO2012114230 | | 8/2012 |

* cited by examiner

ATOMIZING SPRAY APPARATUS

FIELD OF THE INVENTION

The present invention relates to a spray dispensing apparatus, and more particularly to an apparatus for dispensing a liquid drawn from a reservoir as an atomized spray.

BACKGROUND

In many applications directed or related for example to dispensing of liquids, such as dispensing of deodorizing agents into the atmosphere, application of disinfectant or cleaning solutions to a surface, application of pesticides or fertilizers or the like to agricultural product to name only a few, it is desirable that a liquid agent, or particulate agent suspended in liquid, be dispensed as small droplets in a spray form.

Currently it is convenient and typical to store a liquid agent in a pressurized reservoir in its liquid form and then to expel the liquid from the reservoir with the aid of a propellant gas so that the liquid is dispersed into the surrounding atmosphere. Alternatively, liquid particles may be entrained within a pressurized gas stream prior to leaving the reservoir outlet, or allowed to evaporate in a lower pressure region outside the reservoir in order to achieve a spray-like dispersion.

The sprayed dispersion of the liquid in such manners can be difficult to accurately control. For example, there may be a difficulty in controlling the volume of liquid in part due to non-uniformity of the flows of gas and/or liquid leaving the reservoir. This is undesirable in applications where a measured dose of the agent is required, or where the agent needs to be applied at a particular rate.

Additionally, there may be variability in the size of droplets in such a spray. Those droplets which are too large or heavy may not be effectively and uniformly dispersed into the surrounding environment, resulting in areas of excessively high concentration of the agent proximate to the spray outlet and/or areas of insufficiently low concentration farther from the spray outlet. In the example of pesticide application, areas of high concentration may result in plant toxicity due to over-application. In the example of disinfectant application, the areas of low concentration may result in insufficient sterilization, or over-application in areas resulting from attempts to avoid or mitigate such areas of low concentration.

It is therefore an object of the present invention to provide a apparatus for dispensing a liquid drawn from a reservoir as an atomized spray which addresses or overcomes such disadvantages.

SUMMARY

One embodiment of the present invention can be described as an atomizing spray apparatus, comprising a liquid reservoir, a pump and a liquid atomizing unit arranged in a substantially closed-loop circuit, wherein a liquid stored in the reservoir is drawn from the reservoir and delivered to the atomizing unit by the pump. The liquid is applied to the atomizing unit, whereby the liquid is atomized and emitted from the spray apparatus as an atomized liquid spray. Excessive amounts of the liquid applied to the atomizing unit, such as runoff from the atomizing unit which has not been atomized and dispersed, is collected and returned to the reservoir in a substantially closed loop path.

In certain embodiments, a spray apparatus comprises a pump; a reservoir in fluid communication with said pump; an atomizing unit in fluid communication with said pump and said reservoir; wherein said atomizing unit comprises a housing having at least a front and a rear wall and defining an enclosed interior space, the front wall having an aperture defined therethrough; an ultrasonic atomizer disposed within said interior space proximate to said aperture; a fluid supply port extending through said housing and into said interior space, the fluid supply port being arranged to deliver a fluid pumped by said pump to said ultrasonic atomizer; an overflow return port extending through said housing and into said interior space, the overflow return port being arranged to return fluid from said interior space to said reservoir.

According to certain embodiments, the ultrasonic atomizer comprises an annular ultrasonic vibrator and a circular diaphragm disposed to be vibrated by said ultrasonic vibrator.

According to certain embodiments, the housing further comprises in internal weir wall defining a fluid receiving space and a fluid overflow space within the interior space of said housing.

According to certain embodiments, the fluid supply port is arranged to deliver the fluid into the fluid receiving space.

According to certain embodiments, the overflow return port is arranged to return fluid from the overflow space to the reservoir.

According to certain embodiments, the fluid supply port is arranged to direct a stream of liquid against a surface of the atomizing unit.

According to certain embodiments, the fluid supply port is arranged to direct a stream of liquid against a surface of a diaphragm.

According to certain embodiments, the diaphragm comprises a plurality of perforations.

According to certain embodiments, the reservoir, fluid supply port, ultrasonic atomizer and fluid return port are arranged in a substantially closed-loop fluid path.

According to certain embodiments, the ultrasonic vibrator is configured to vibrate the diaphragm at a resonant frequency of the diaphragm.

According to certain embodiments, the ultrasonic vibrator is configured to self-tune to a resonant frequency of the diaphragm.

According to certain embodiments, a resonant frequency of the diaphragm is between 50 kHz and 2.7 MHz.

According to certain embodiments, the ultrasonic atomizer is mounted to the housing with a compliant support structure.

According to certain embodiments, the compliant support structure comprises a single elastomeric moulding of silicone rubber, synthetic thermoplastic rubber or synthetic vulcanized rubber.

According to certain embodiments, the elastomeric moulding is configured to retain the vibrating element with a minimum of vibrational damping.

According to certain embodiments, the compliant support structure forms a fluid seal between the ultrasonic atomizer and the housing.

According to certain embodiments, the spray apparatus comprises: a pump; a reservoir in fluid communication with said pump; an atomizing unit in fluid communication with said pump and said reservoir; wherein said atomizing unit comprises a housing having at least a front and a rear wall and defining an enclosed interior space, the front wall having an aperture defined therethrough; an ultrasonic atomizer disposed within said interior space proximate to said aperture; a fluid supply port extending through said housing and into said interior space, the fluid supply port being arranged to deliver a fluid pumped by said pump to said ultrasonic atomizer; a fluid overflow space defined within said interior space;

wherein said fluid overflow space is arranged to collect excess fluid overflown from said ultrasonic atomizer.

According to certain embodiments, the ultrasonic atomizer comprises an annular ultrasonic vibrator and a circular diaphragm disposed to be vibrated by said ultrasonic vibrator.

According to certain embodiments, the fluid supply port is arranged to direct a stream of liquid against a surface of said circular diaphram.

These and other features, aspects, and advantages of the present invention will become better understood with regard to the following description, appended claims, and accompanying drawings.

DETAILED DESCRIPTION OF VARIOUS EMBODIMENTS

Figure 1:
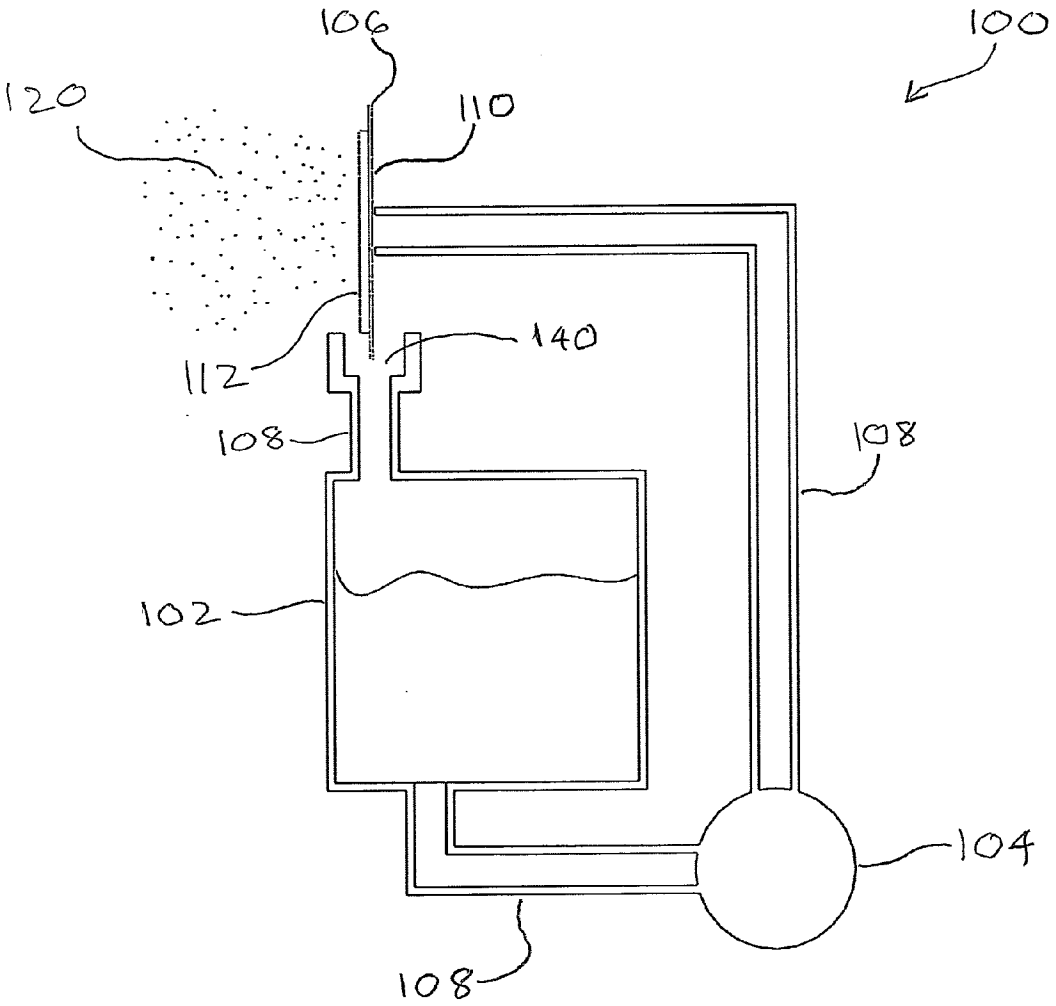
FIG. 1 is a diagrammatic illustration of a generalized embodiment of the present invention.

Referring to FIG. 1, a spray apparatus 100 of the present invention can be broadly viewed as a comprising a liquid reservoir 102, a pump 104 and a liquid atomizing unit 106 arranged in a substantially closed-loop circuit, including a conduit 108 for delivering a liquid from the reservoir 102 to the pump 104, a conduit 108 for delivering the liquid from the pump 104 to the atomizing unit 106 and a conduit 108 for delivering liquid in a return path from the atomizing unit 106 back to the reservoir 102.

Various types of liquid atomizing units 106 may be used. In the illustrated embodiments, an ultrasonic diaphragm-type atomizing unit 106 is used. Typically, ultrasonic diaphragm atomizers which are well known comprise a diaphragm 110 and a means 112 for driving the diaphragm 110 to vibrate at an ultrasonic frequency, such that a liquid applied to a surface of the diaphragm 110 is atomized by the ultrasonic vibration of the diaphragm 110. In the arrangement of FIG. 1, a liquid is delivered to a rear surface 116 of the diaphragm 110, such that some of the liquid is atomized and emitted as an atomized spray 120, and an amount of excess liquid (for example, liquid delivered to the diaphragm 110 in excess of the atomizing rate capacity of the atomizing unit 106) is collected and returned to the reservoir 102. The diaphragm 110 may be perforated to facilitate transfer of the liquid from the rear surface 116 to the front surface 118 for emission of the atomized spray 120.

Liquid may be applied to the diaphragm 110 in various ways. For example, in certain embodiments the diaphragm 110 may be simply immersed, entirely or partly, within a liquid container. In other embodiments, the liquid may be applied directly to the diaphragm 110 by directing a liquid stream toward the rear surface of the diaphragm 110, or by transferring the liquid via a continuous liquid droplet coupling spanning a gap between a delivery conduit to a diaphragm 110 surface.

Figure 2:
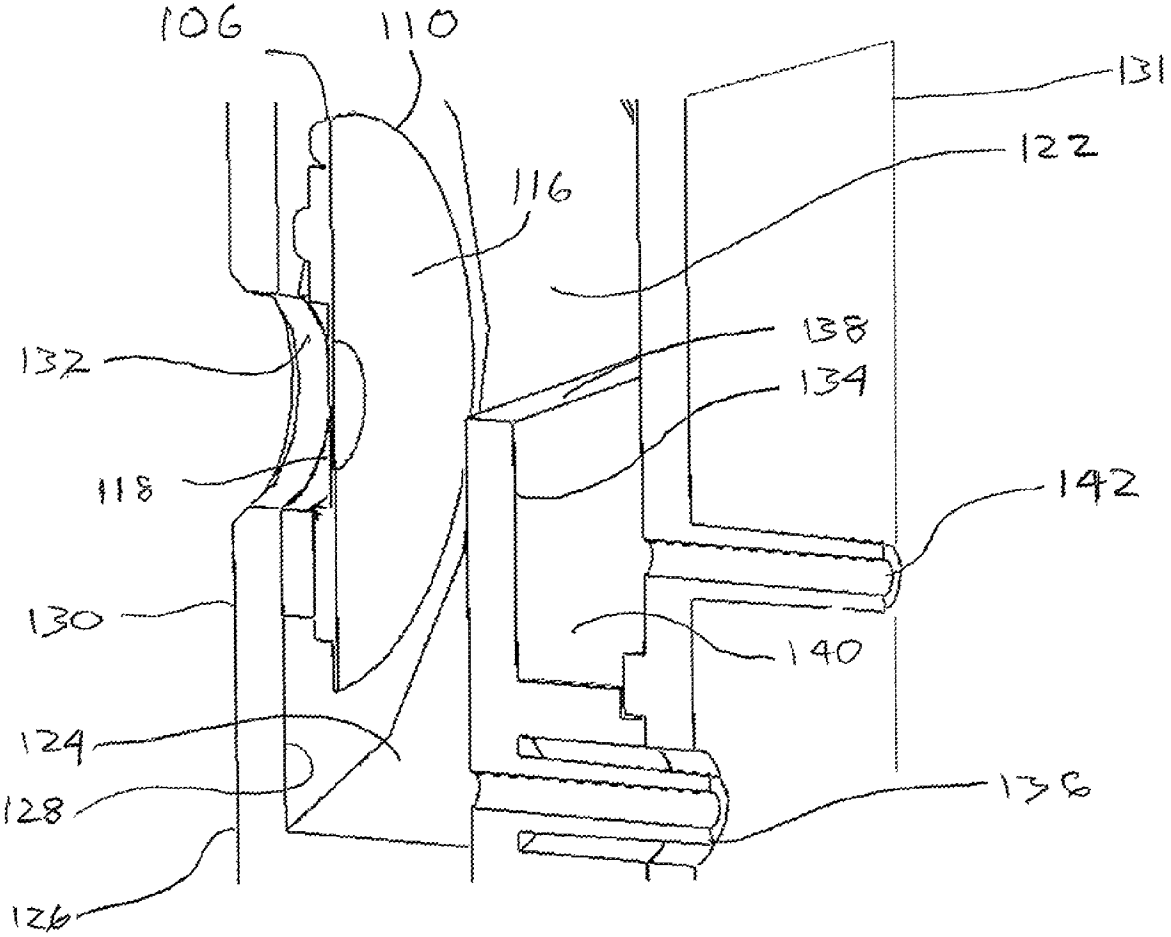
FIG. 2 is a cutaway diagram of one embodiment of an enclosure and mounting arrangement for a liquid atomizer.

Turning to FIG. 2, an arrangement for mounting the atomizing unit 106 within a containment space 122 is shown, wherein the atomizer's diaphragm 110 is arranged to be partially immersed within a liquid containment space 124. A container housing 126 is substantially enclosed and defined by front, rear, side, top and bottom walls, wherein the atomizing unit 106 is mounted to an inside surface 128 of the front wall 130 proximate to an aperture 132 through the front wall 130, such that an atomized spray 120 generated by the atomizer's diaphragm 110 is emitted outwardly through the front wall 130 via the aperture 132. Within an internal space 133 of the housing 126, a weir wall 134 is provided extending upward from the bottom of the housing 126, to define a liquid containment space 124. A feeder passage 136 is provided at a low position through the weir (or otherwise through the housing 126) into the liquid containment space 124, allowing for passage of a liquid into the liquid containment space 124.

It can be recognized that the level or depth of immersion of the diaphragm 110 into the liquid in the liquid containment space 124 is defined by the height of the weir 134. That is, as the liquid fills the liquid containment space 124 to reach the level of the top 138 of the weir 134, additional or excess liquid spills over the weir 134 to maintain a constant liquid depth within the liquid containment space. An overflow space 140 behind the weir 134 is provided with a liquid outlet 142 for delivery of the overflowed liquid back to the reservoir 102, or directly back to the pump 104 in arrangements where the overflow space 140 is of a sufficient volume to serve as the reservoir 102.

Considering the liquid circuit of FIG. 1, it can be recognized that in arrangements such as the embodiment of FIG. 2, a pump 104 may be configured together with the atomizing unit 106 in a single housing 126; the pump 104 may be configured in a separate but closely coupled housing 126; or the pump 104 may be disposed remotely from the atomizing unit 106 and its housing 126 most literally corresponding to the liquid circuit of FIG. 1. In this regard, it can be further recognized that the conduits 108 of FIG. 1 may be di minimis in the nature of their size and structure or may be essentially eliminated in consideration of a degree of proximity and integration or collocation of the pump 104 together with the atomizing unit 106.

Figure 3:
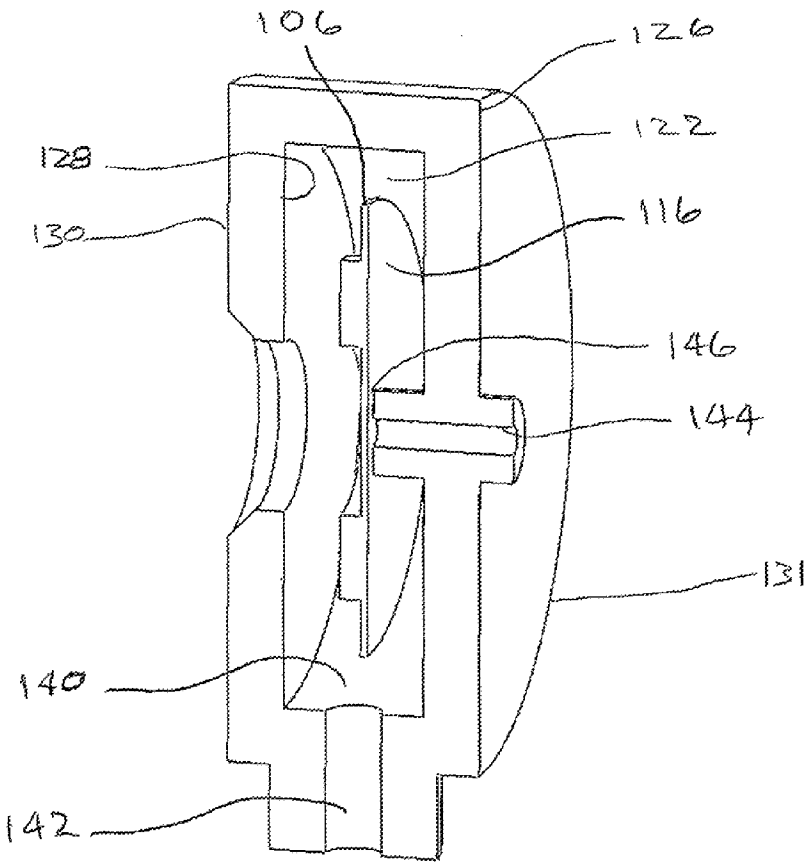
FIG. 3 is a cutaway diagram of another embodiment of an enclosure and mounting arrangement for a liquid atomizer.

Turning to FIG. 3, an arrangement for mounting the atomizing unit 106 within a containment space is shown, wherein the atomizer's diaphragm 110 is arranged for direct feeding of the liquid against the rear surface 116 of the diaphragm 110. As in the previous embodiment, a container housing 126 is substantially enclosed and defined by front, rear, side, top and bottom walls, wherein the atomizing unit 106 is mounted to an inside surface 128 of the front wall with its diaphragm 110 proximate to an aperture 132 through the front wall 130, such that an atomized spray generated by the diaphragm 110 is emitted outwardly through the front wall 130 via the aperture 132.

In this embodiment, a feeder passage 136 is provided through the rear wall 131 of the housing 126, and a feeder tube 144 extends to a position close to the rear surface 116 of the diaphragm 110. Preferably, the feeder tube 144 extends close to the rear surface of the diaphragm, but does not contact the diaphragm 110. At small distances between the feeder tube 144 and the rear surface of the diaphragm 110, a continuous fluid droplet coupling can be established within a small gap 146 between the feeder tube 144 and the diaphragm 110. That is, a continuously formed small liquid droplet bridging the gap 146 between the feeder tube 144 and the diaphragm 110 is established and maintained by delivering the liquid at approximately the same rate as the liquid is atomized and disbursed. As can be recognized and understood, the liquid droplet coupling maintains its integrity due to surface tension phenomena, and as such it can be understood that the extent of the gap between the feeder tube 144 and the diaphragm 110, as a well as the size and geometry of the outlet of the feeder tube 144 (such as the feeder tube diameter) will be influenced by factors including liquid feed rate, viscosity of the liquid, atomization rate of the atomizer as well as physical or material characteristics of the feeder tube and diaphragm.

It can be recognized that delivery of the liquid at greater than such an "equilibrium" rate may result in unatomized liquid running off of the diaphragm 110. Hence, a bottom portion 139 of the internal space 133 of the housing 126 serves as a liquid overflow or collection space 141, and a liquid outlet 142 is provided in the collection space 141 for delivery of the excess liquid back to the reservoir 102, or directly back to the pump 104 in arrangements where the collection space 141 is sufficient in volume to serve as the reservoir 102. The liquid outlet 142 may be simply placed at the bottom of the housing 126, such that a bottom portion of the housing 126 serves as the collection space 141.

Another approach to application of the fluid to the diaphragm 110 as an alternative to the liquid droplet coupling is simply to propel the liquid from the feeder tube 144 at a rather large volume, essentially spraying the liquid against the diaphragm 110 at a rate in excess of the atomization capacity, maintaining liquid coverage of the diaphragm while generating an excess of liquid as runoff from the diaphragm 110 to be returned to the reservoir 102.

On the other hand, it can be understood that delivery of the liquid at less than an equilibrium rate may result in starving the atomizing unit 106, leading to intermittent atomization, or perhaps to a failure of the liquid droplet coupling resulting in no atomization as the liquid emitting from the feeder tube 144 at sufficiently low rates may simply fail to reach the rear surface 116 of the diaphragm.

Figure 4:
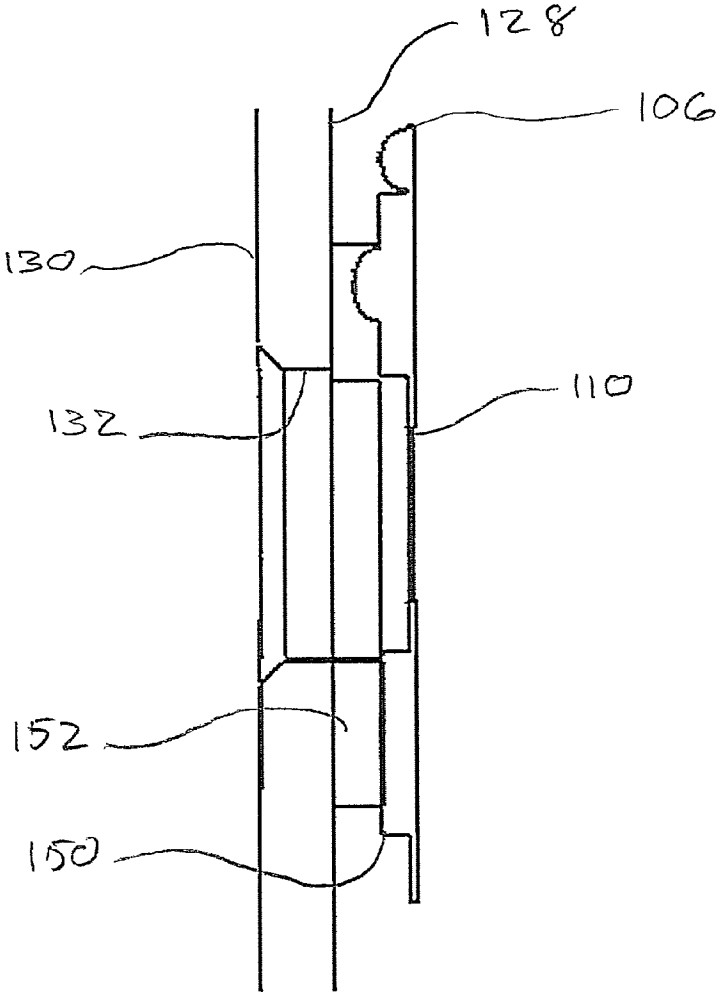
FIG. 4 is a detailed section view of an embodiment of an atomizing unit.

Considering the atomizing unit 106 illustrated in FIGS. 2 and 3, and shown in greater detail in FIG. 4, as already described the atomizing unit 106 comprises a diaphragm 110 and a means 112 for driving the diaphragm 110 to vibrate at an ultrasonic frequency, such that a liquid applied to a surface of the diaphragm 110 is atomized by the ultrasonic vibration of the diaphragm 110. Generally, the means 112 for driving the diaphragm 110 may be an ultrasonic transducer 148 coupled to the diaphragm 110. In the illustrated embodiments, the ultrasonic transducer 148 for driving the diaphragm 110 is a ring-shaped or annular transducer having a central aperture. The ultrasonic transducer may be further considered, among other structures, to comprise a plate 150 and a vibrating unit 152 coupled to the plate 150. For example, an ultrasonic transducer may be structured as comprising an annular plate 150, and a piezoelectric component or another vibrating unit 152 coupled to the plate 150 for vibrating the plate 150, with the diaphragm 110 coupled in turn to the plate 150.

Figure 9:
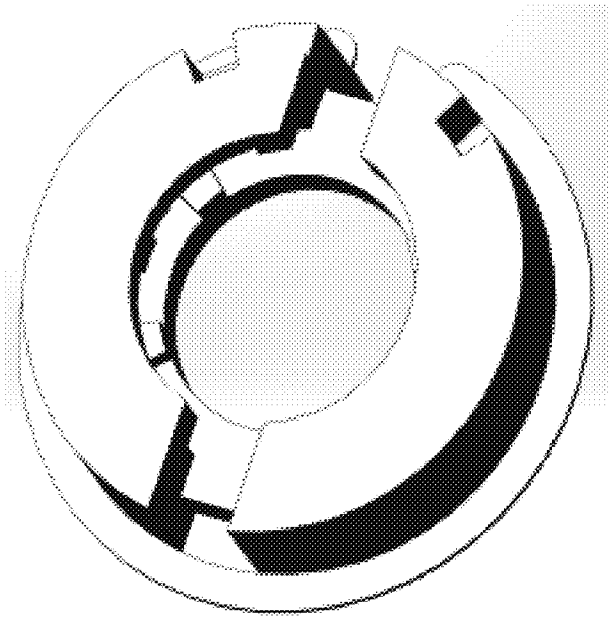
FIG. 9 is a perspective view of an embodiment of a supporting member for an atomizing unit.
Figure 8:
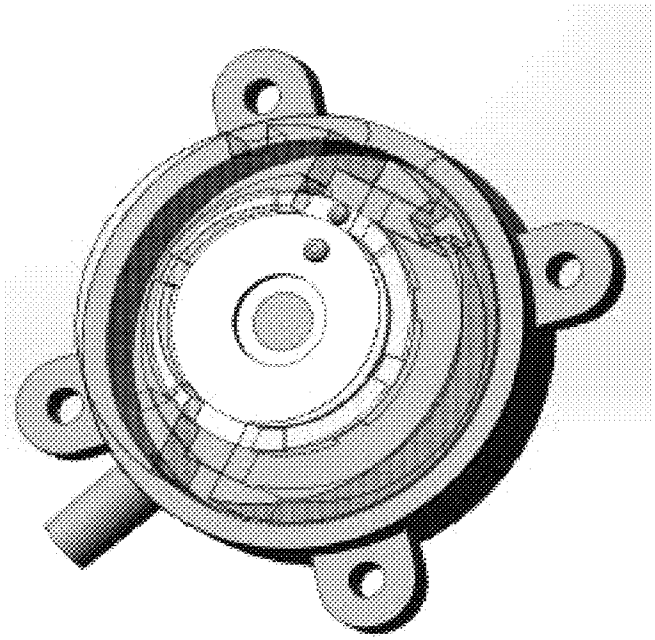
FIG. 8 is a perspective cut-away view of an embodiment of a mounting assembly for an atomizing unit.

In certain embodiments, referring to FIGS. 8 and 9, the atomizing unit 106 is mounted to the housing 126 with a compliant support structure consisting of a single elastomeric moulding of silicone rubber, synthetic thermoplastic rubber, synthetic vulcanized rubber or similarly soft material, which is configured to retain the vibrating element with a minimum of vibrational damping, by means of a minimal coupling to the element, just sufficient to maintain its physical position relative to the housing 126. Such an arrangement results in a precise disposal of the element relative to the housing 126, while offering the minimum of damping influence from surrounding apparatus. In addition, the compliant support structure is so formed as to provide an integral gasket to seal the chamber local to the atomizing unit 106, preventing leakage of unsprayed fluid that runs off the element and returns to the reservoir.

It is desirable to operate the atomizing unit 106 at a resonant frequency of the diaphragm in a range expected to lie between 50 kHz and 2.7 MHz. To achieve this, in certain embodiments a self-tuning mechanism is employed to eliminate a requirement for a static tuning step during manufacture. Various methods may be used for the self-tuning. In one such method, a supply voltage drop is monitored to assess that resonance is reached, wherein a maximum drop suggests maximum power drain which in turn suggests resonance. By frequency sweeping in conjunction with this monitoring, the optimal or resonant frequency can be found.

Alternatively, the current drawn by the transducer can be monitored, wherein at an optimal resonant frequency, the current drawn will be at a characteristic maximum level. Again, frequency sweeping is employed with the current monitoring to identify the optimal frequency.

In another method, a short power supply pulse is provided to the transducer, energising it momentarily and allowing the device to ring at its natural (resonant) frequency, which can then be measured electronically. The measured value is then used to set the drive frequency.

Further, rather than a forced drive scheme, the transducer can be incorporated into a self-oscillating circuit (such as a tank circuit), and simply allowed to oscillate at a natural resonant frequency of the tank circuit.

While other shapes and configurations of the atomizing unit 106 may be employed, the annular atomizing unit 106 can be recognized as advantageous in that the annular structure of the ultrasonic transducer along with the diaphragm 110 covering both the opening of annular transducer and the aperture 132 in the housing front wall 130 reduces the possibility of spillage of the liquid from within the housing's liquid containment or collection spaces, since the liquid is retained behind the diaphragm 110 within the housing 126. Similarly, while alternative arrangements of the feeder tube 144 or the atomizing unit 106 itself may be employed allowing delivery of the liquid directly to the front surface 118 of the diaphragm, arrangements delivering the liquid behind the diaphragm 110 reduce the possibility of spillage.

Figure 5:
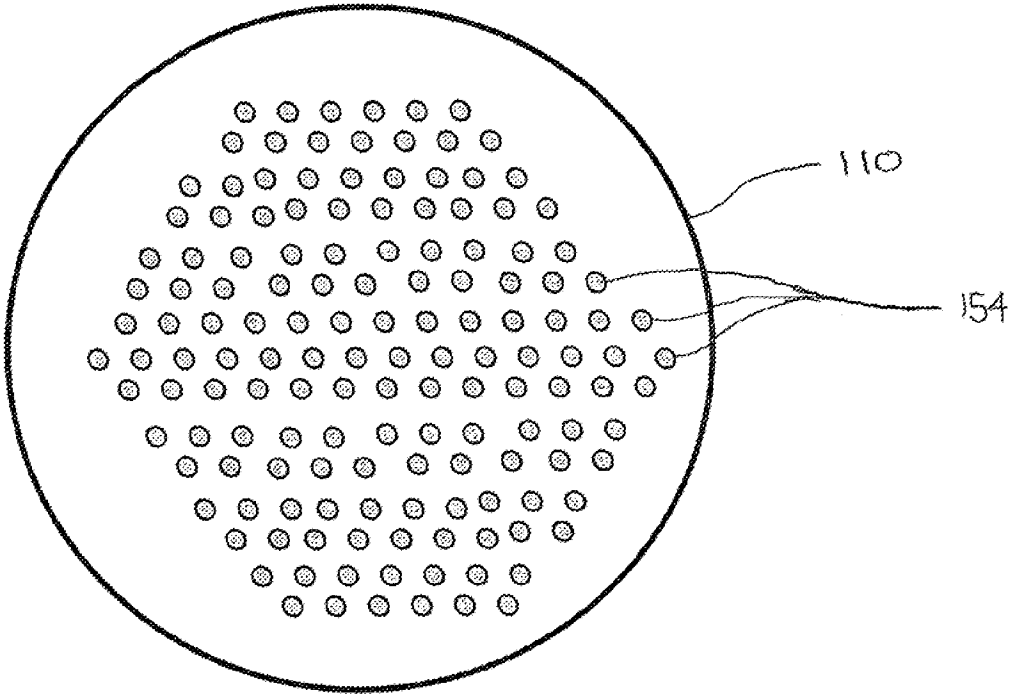
FIG. 5 is a plan view of an atomizing diaphragm of certain embodiments of the invention.
Figure 6:
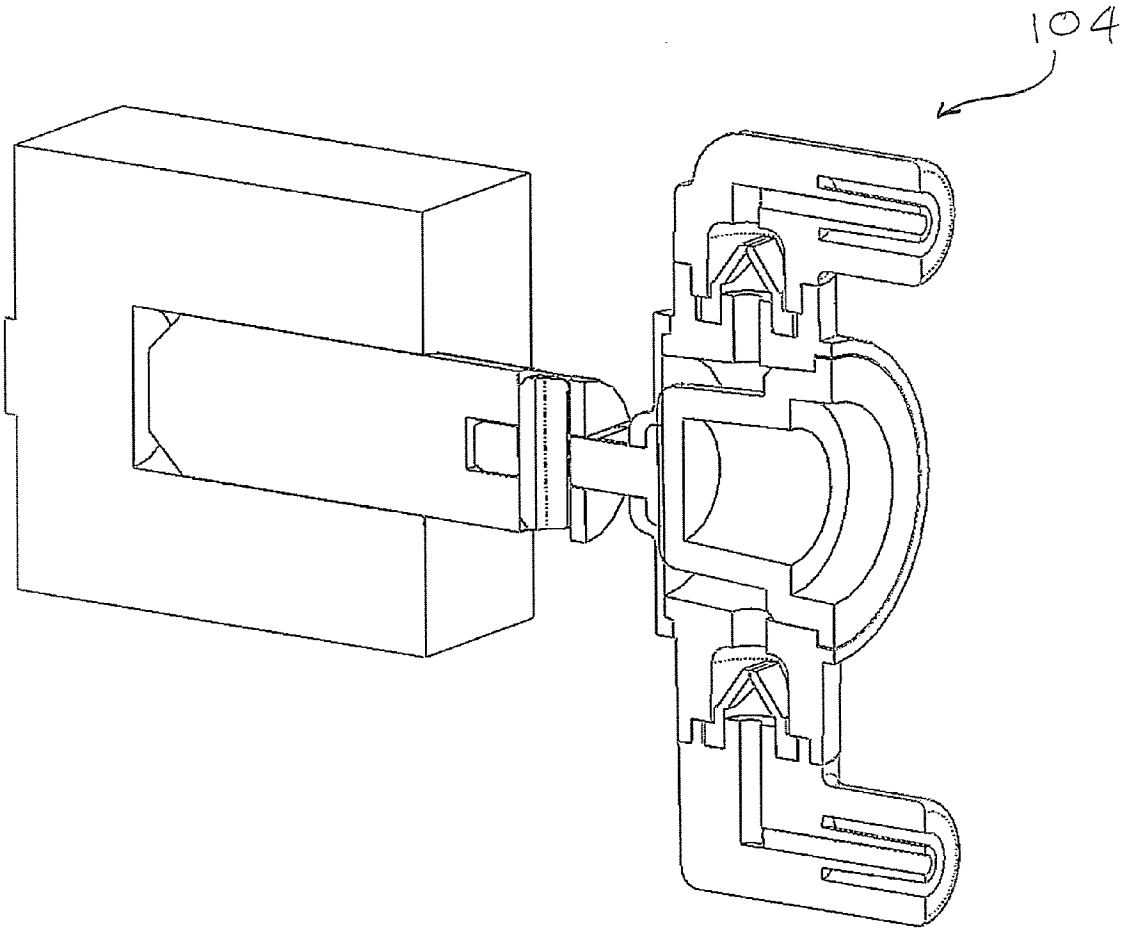
FIG. 6 is a section view of a pump usable in certain embodiments.

The diaphragm 110 itself, in the illustrated embodiments, is of a generally circular disk shape as corresponding to the annular atomizing unit 106. Referring to FIG. 5, the diaphragm 110 is formed with a plurality of perforations 154 to allow passage of the liquid from the rear surface 116 to the front surface 118 of the diaphragm 110. Of course, the depiction of the diaphragm's perforations in FIG. 6 is illustrative only, and is not intended to show the perforations in actual dimensions or in an actual layout.

The frequency of the vibration of the ultrasonic transducer 148 has been found to influence the size of the spray droplets or particles produced. The surface tension and density or viscosity of the liquid being atomized, and the aperture size of the perforations 154 of the diaphragm 110 also influence the resultant size of the droplets. Typically the median size of the atomized spray is generally inversely proportional to the frequency of the ultrasonic transducer 148. In experiments the applicant has found the drop size distribution from the atomizing unit 106 often to follow a log-normal distribution curve. The operational frequency for any given application may be influenced by the required spray particle size, as well as characteristics of the fluid to be dispensed. For many applications, operation of the atomizing unit 106 at a frequency between 50 kHz and 2.7 mHz produces acceptable results, with higher operating frequencies resulting in smaller particle sizes and lower frequencies resulting in larger particle sizes. Of course, operation of the atomizing unit 106 at frequencies outside of this range may serve particular needs of applications requiring still greater or smaller particle sizes or applications employing liquids having unique characteristics such as extreme viscosity, density or the like.

A targeted particle size will depend on the nature of any particular application in which the spray dispensing device is being used. Control over the particle size can be achieved by selection of an operating frequency, characteristics of the liquid, characteristics of the diaphragm as discussed above. In embodiments of the present invention, particle sizes may range from a 1 μm (or smaller) mean size up to 100 μm mean size. In some embodiments medical size particles (sub 5 μm mean diameter) will result from excitation frequencies in the MHz range with a proportional relationship between particle size and excitation frequency. In some embodiments environmental agents will require larger particles to deliberately avoid medical sizes ranges and these will result from lower frequencies in the hundreds of KHz ranges.

For example, certain medical applications may relate to inhalation of a therapeutic agent, intended to reach pleural cavities, bronchi, sinuses or the like depending on the target of a particular therapy. Particle sizes in a range of 1-3 μm might be used for pleural penetration, while 2-5 μm may best target a bronchial therapy while a range of 5-8 μm may best target sinuses, with larger particle sizes such as greater than 10 μm being suitable for topical application. On the other hand, it can be similarly recognized that larger particle sizes may be specifically targeted with the intent to avoid inhalation of the particles, or exposure to pleural cavities, bronchi and sinuses.

For some applications it is desired that the atomized spray be able to remain suspended in the air under normal atmospheric conditions for a prolonged period of time to enable adequate dispersion of the spray after dispensation, and so the production of small and light spray particles is required. For example, in a room humidifying application such continued suspension may be desired In practice, the size distribution of the particle or droplet sizes achieved by the present invention occurs within very narrow ranges typical for particular frequencies. For example, spraying water at 142 kHz may result in a particle distribution in which 98% of particles are in the range of 5 to 18 μm. The droplet size may be tightly controlled in a narrow range selected to suit a particular application. In some embodiments the diameters of the droplets of the atomised spray may be maintained in a narrow band of 8-20 μm spread of diameter encompassing at least 95% of all particles. In some embodiments the diameters of the droplets of the atomised spray may be maintained in an even narrower band of 8-15 μm spread of diameter encompassing at least 95% of all particles. Alternatively, such a band may be a normal distribution of particle sizes of +/−50% of the mean or target diameter.

The flow rate of the spray delivered, and the accuracy with which this can be controlled, relates at least partially on the type of pump 104 used to deliver liquid to the atomizing unit 106. The flow rate of liquid delivered by the pump 104 may be selected according to the type of atomizing unit 106 employed, and of course according to requirements for a particular application. In embodiments where compactness or miniaturization is desired the pump 104 may be a micropump. A pump 104 or micropump with a repeatable and consistent stroke capable of delivering precise volumes of the liquid with each pump cycle or pulse is desirable for applications where precise dosing or control of the emitted atomized spray is desired. The pump 104 or micropump may comprise a diaphragm pump, a syringe pump, a peristaltic pump, a piezoelectric picopump or another type pump. For example, a diaphragm micropump, such as shown in FIG. 6, is a practical choice as being low in cost to manufacture, easy to drive, having low power consumption, and being highly robust.

The output flowrate of spray be determined as depending on the application, as discussed above. However the applicant has found that operation of an atomizer system in accordance with the present invention provides an increase in the volumetric flowrate of spray output of up to two orders of magnitude when compared with known ultrasonic transducer arrangements. For example, where such a known system delivers approximately 3-5 μl/s with a 2 watt electrical input, a similarly dimensioned system of the present invention with the same electrical input will deliver up to 120 μl/s, and typically 30-80 μl/s. Experiments also show an increase in spray system efficiency (in terms of electrical energy input required to dispense a given amount of spray) over electronically activated aerosol pump type arrangements.

In another aspect of the invention, embodiments of the spray apparatus or the atomizing units as previously described may be arrayed to provide an atomized spray application across a large area, or of a particularly high volume or both.

Figure 7:
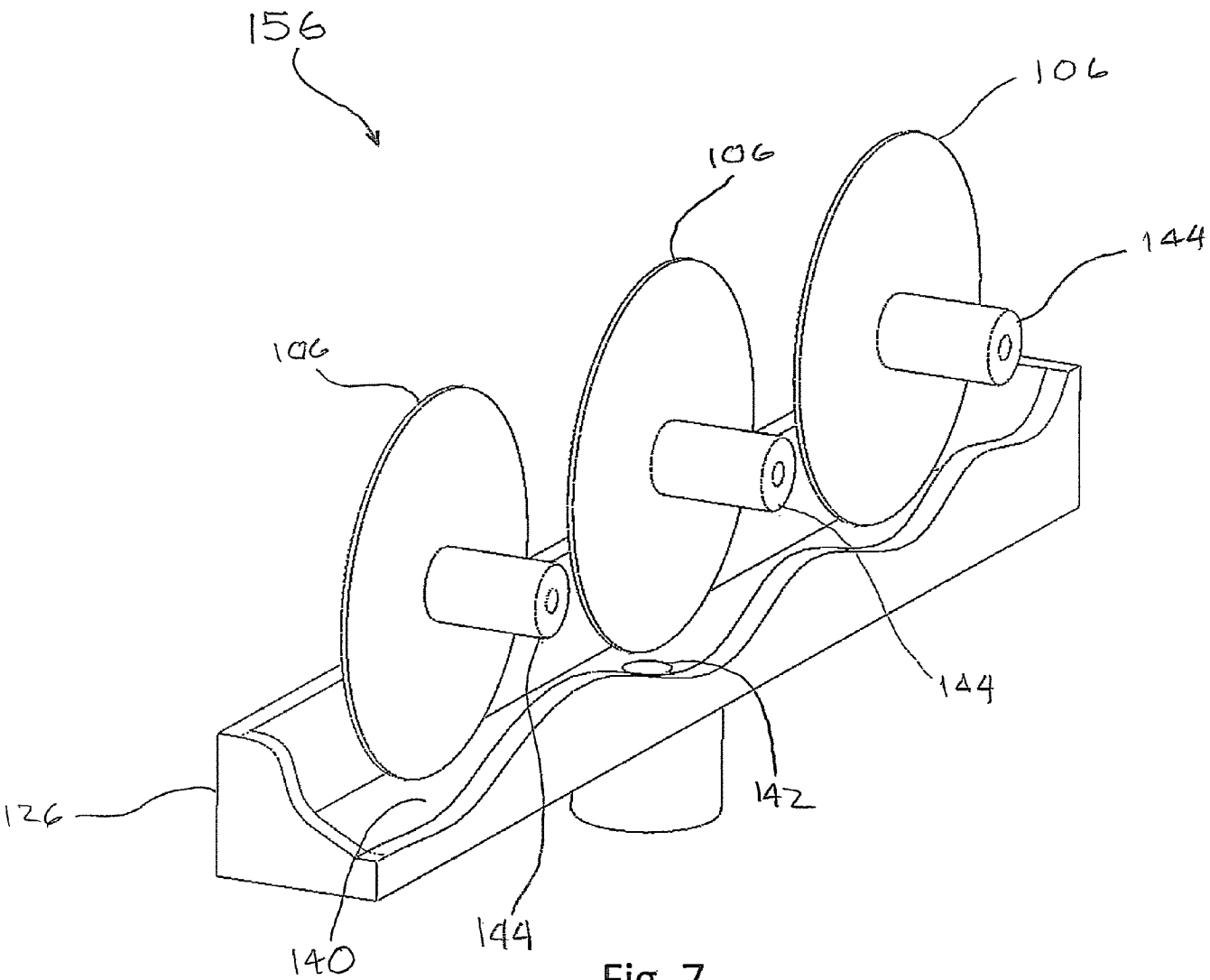
FIG. 7 is a cutaway diagram of an embodiment of plural, arrayed liquid atomizers.

For a given application, the volume of liquid which needs to be dispensed as a spray will depend upon the dispensing element or transducer power and/or operating frequency and also on the diameter of the spray particles. It can be recognized that an area that can be treated by the spray output of a single spray apparatus may be sized according to the spray rate and volume, spray particle sizes and their drift characteristics within the environment in question. For example, for some embodiments, a treated volume of 200 cubic meters may be treated by a single spray device emitting 20-50 μl of particles of 10 μm mean diameter every 7-12 minutes. It can be recognized that additional arrayed spray devices can achieve correspondingly larger coverage area simply by the addition of additional units. For example, in a rather large application environment such as a greenhouse, plural atomizing units 106 arranged together in an array may be employed. Referring to FIG. 7, one embodiment of an array 156 is illustrated comprising a plurality of atomizing units 106 within a single housing 126, wherein each of the atomizing units 106 is associated with an individual liquid feeder tubes 144, while a single liquid outlet 142 is provided in the housing 126 for collective return of unatomized runoff from each of the atomizing units 106. Alternative arrangements may include compartmentalization of the single housing 126 to separate the atomizing units 106, with a separate fluid liquid outlet 142 associated with each of the atomizing units 106, or separate housings 126 for each of the atomizing units 106 in the array, wherein the separate housings 126 may be collocated or separately located with respect to one another.

In such arrayed embodiment, there may provided individual control of each individual spray apparatus 100 or atomizing unit 106 within an array 156, of groups of the spray apparatus 100 or atomizing units 106 within the array 156 or uniformly of the entire array 156, such that distributed delivery of the spray particles can be achieved. It can be recognized that control elements may include electronic control of the pumps 104 as relating to the volume of the liquid delivered, as well as control of the atomizing units 106 as relating to the operating frequency or "bursty" operation at timed intervals or the like. Further, such control apparatus may be collocated with each or any of the spray apparatus and operated manually, by timer or by preprogramming. Similarly, a control unit may be remotely located. Such a control unit may include one or more sensor which may measure an environmental factor or fluid delivery factor which may be employed by the control unit. For example, factors such as temperature, humidity, wind speed or wind direction may be useful in determining application of agricultural agents or the like in an outdoor setting. Also, measurement of the applied liquid at its application target may be used to determine sufficiency of an application, or a need for further application, which may be directed by the control unit. Hence, timing and periodicity of actuation may be adjusted or determine based on such factors, in order to achieve optimal spray distribution and delivery.

It will be understood that the above-described embodiments of the invention are illustrative in nature, and that modifications thereof may occur to those skilled in the art. Accordingly, this invention is not to be regarded as limited to the embodiments disclosed herein, but is to be limited only as defined in the appended claims.

I claim:

1. A spray apparatus, comprising:

a pump;

a reservoir in fluid communication with said pump;

an atomizing unit in fluid communication with said pump and said reservoir;

wherein said atomizing unit comprises a housing having at least a front and a rear wall and defining an enclosed interior space, the front wall having an aperture defined therethrough;

an ultrasonic atomizer disposed within said interior space proximate to said aperture;

a fluid supply port extending through said housing and into said interior space, the fluid supply port being arranged to deliver a fluid pumped by said pump to said ultrasonic atomizer;

an overflow return port extending through said housing and into said interior space, the overflow return port being arranged to return fluid from said interior space to said reservoir;

a weir wall disposed within said interior space defining a fluid receiving space and a fluid overflow space within the interior space of said housing, wherein said fluid supply port is arranged to deliver the fluid into said fluid receiving space and said overflow return port is arranged to return fluid from said overflow space to said reservoir;

wherein said ultrasonic atomizer is arranged within said fluid receiving space.

2. The spray apparatus of claim 1, wherein said ultrasonic atomizer comprises an annular ultrasonic vibrator and a circular diaphragm disposed to be vibrated by said ultrasonic vibrator.

3. The spray apparatus of claim 2, wherein said diaphragm comprises a plurality of perforations.

4. The spray apparatus of claim 1, wherein said reservoir, said fluid supply port, said ultrasonic atomizer and said fluid return port are arranged in a substantially closed-loop fluid path.

5. The spray apparatus of claim 2, wherein said ultrasonic vibrator is configured to vibrate said circular diaphragm at a resonant frequency of said circular diaphragm.

6. The spray apparatus of claim 5, wherein said ultrasonic vibrator is configured to self-tune to said resonant frequency.

7. The spray apparatus of claim 5, wherein said resonant frequency is between 50 kHz and 2.7 MHz.

8. The spray apparatus of claim 1, wherein said ultrasonic atomizer is mounted to said housing with a compliant support structure.

9. The spray apparatus of claim 8, wherein said compliant support structure comprises a single elastomeric moulding of silicone rubber, synthetic thermoplastic rubber or synthetic vulcanized rubber.

10. The spray apparatus of claim 9, wherein said elastomeric moulding is configured to retain said ultrasonic atomizer with a minimum of vibrational damping.

11. The spray apparatus of claim 8, wherein said compliant support structure forms a fluid seal between said ultrasonic atomizer and said housing.

12. A spray apparatus, comprising:

a pump;

a reservoir in fluid communication with said pump;

an atomizing unit in fluid communication with said pump and said reservoir;

wherein said atomizing unit comprises a housing having at least a front and a rear wall and defining an enclosed interior space, the front wall having an aperture defined therethrough;

an ultrasonic atomizer disposed within said interior space proximate to said aperture;

a fluid supply port extending through said housing and into said interior space, the fluid supply port being arranged to deliver a fluid pumped by said pump to said ultrasonic atomizer;

a fluid overflow space separated from a fluid receiving space by a weir wall defined within said interior space;

wherein said ultrasonic atomizer is disposed in said fluid receiving space, and wherein said fluid overflow space is arranged to collect excess fluid.

13. The spray apparatus of claim 12, wherein said ultrasonic atomizer comprises an annular ultrasonic vibrator and a circular diaphragm disposed to be vibrated by said ultrasonic vibrator.

* * * * *